US007117809B2

(12) United States Patent
Lamoureux et al.

(10) Patent No.: US 7,117,809 B2
(45) Date of Patent: Oct. 10, 2006

(54) FLOATING DRY DOCK FOR LIGHT WATERCRAFTS

(75) Inventors: Serge Lamoureux, Magog (CA); Julie Trépanier, Rock Forest (CA); Michel Bourassa, Rock Forest (CA); Éric La Violette, Rock Forest (CA)

(73) Assignee: Candock Inc., Deauville (CA)

( * ) Notice: Subject to any disclaimer, the term of this patent is extended or adjusted under 35 U.S.C. 154(b) by 6 days.

(21) Appl. No.: 10/813,072

(22) Filed: Mar. 31, 2004

(65) Prior Publication Data

US 2005/0217552 A1 Oct. 6, 2005

(51) Int. Cl.
*B63C 1/02* (2006.01)
*B63C 1/08* (2006.01)

(52) U.S. Cl. ..... 114/263

(58) Field of Classification Search ..... 114/44–48, 114/258, 259, 263, 344, 264, 267; 405/1–7, 405/218–220

See application file for complete search history.

(56) References Cited

U.S. PATENT DOCUMENTS

| | | | | | |
|---|---|---|---|---|---|
| 3,224,019 | A | * | 12/1965 | Gudmundson | 114/344 |
| 3,339,217 | A | * | 9/1967 | Gudmundson | 114/344 |
| 3,734,046 | A | * | 5/1973 | Schmidt et al. | 114/259 |
| 3,785,312 | A | | 1/1974 | Schneider | |
| 3,970,024 | A | | 7/1976 | Fisher | |
| 4,260,282 | A | * | 4/1981 | Dorsey et al. | 405/1 |
| 4,604,962 | A | | 8/1986 | Guibault | |
| 4,781,392 | A | * | 11/1988 | Cooper | 280/414.1 |
| D299,078 | S | * | 12/1988 | Jacobsen | D34/32 |
| 5,107,785 | A | | 4/1992 | Baxter | |
| 5,281,055 | A | * | 1/1994 | Neitzke et al. | 405/219 |
| 5,529,013 | A | * | 6/1996 | Eva et al. | 114/263 |
| 5,645,007 | A | * | 7/1997 | Benton | 114/263 |
| 5,795,098 | A | * | 8/1998 | Rueckert | 405/7 |
| 5,855,180 | A | * | 1/1999 | Masters | 114/263 |
| 5,875,727 | A | * | 3/1999 | Elson et al. | 114/259 |
| 5,931,113 | A | * | 8/1999 | Eva et al. | 114/263 |
| 5,941,660 | A | * | 8/1999 | Rueckert | 405/7 |
| 6,006,687 | A | * | 12/1999 | Hillman et al. | 114/46 |
| 6,073,572 | A | * | 6/2000 | Gruhn et al. | 114/263 |
| 6,145,463 | A | | 11/2000 | Zeilinger | |
| 6,179,525 | B1 | | 1/2001 | Gruhn | |
| 6,431,106 | B1 | * | 8/2002 | Eva et al. | 114/263 |
| 6,470,820 | B1 | | 10/2002 | Wilkins | |
| 6,526,902 | B1 | | 3/2003 | Faber | |

FOREIGN PATENT DOCUMENTS

| | | |
|---|---|---|
| DE | 3404501 | 12/1984 |

* cited by examiner

*Primary Examiner*—Ajay Vasudeva
(74) *Attorney, Agent, or Firm*—Ogilvy Renault LLP; Guy J. Houle

(57) ABSTRACT

A watercraft support platform casing for a floating dry dock for light weight watercrafts is described. The support platform casing has integrally formed floatation chambers and an elongated central ramp is formed in the top surface of the casing to support the hull of a watercraft positioned thereon. The ramp has a trough-like upper surface with a sloped forward entry way formed integral therewith and terminates in a lower forward projecting edge. The support platform is provided with connectors on opposed side walls thereof for a rigid connection with a plurality of floatation casings to support the platform casing on a water surface with the entry way positioned to receive the bow of a watercraft in movement whereby the watercraft can project itself on the central ramp above the water surface.

24 Claims, 7 Drawing Sheets

FLOATING DRY DOCK FOR LIGHT WATERCRAFTS

TECHNICAL FIELD

The present invention relates to a floating dry dock, and more particularly to a watercraft support platform casing which is rigidly connected to floatation casings, whereby to support a light watercraft above the water surface.

BACKGROUND ART

It is known to construct drive-on dry docks whereby a watercraft can enter an entry way of a floatation flexible dock and lodge itself into a channel or on smaller float casings of the dock. Such drive-on dry docks are for example described in U.S. Pat. Nos. 6,431,106, 6,526,902, 5,947,050, and 5,931,113. These dry docks comprise a plurality of floatation casings forming a dock surface on which a person can walk and an entry way in which a watercraft can enter when in motion. There are several problems associated with such flexible docks, one of them being that when the watercraft enters the entry way, it can damage the floatation casings which are disposed in the entry way and usually disposed lower than the surface of the floatation casings to the sides of the entry way. Because these floatation casings are formed of rigid plastic material, repetitive impact by the hull of a watercraft causes wear and tear, and the casings can become punctured and fill with water, causing the dock to sink in the forward entry way, thereby necessitating repair. The repair consists in removing the damaged casing from adjacent casings and because there are several connectors, one at each corner of the casings, this is a time consuming job and often the connectors fall into the water and become lost.

Another disadvantage of these drive-on dry docks is that an open entrance way is formed in the dock to receive a watercraft and because the casings are pivotally secured to one another, they flex with respect to one another, and make it hazardous to a person walking on the dock in the vicinity of the entrance way. Furthermore, these docks are constructed to support only a single watercraft and some of these watercrafts are only partly supported on the dock with the outboard engine in the rear end of the watercraft remaining in the water at the end of the dock. Therefore, the watercraft is still partly submerged. In an attempt to resolve this type of a problem, the outer casing sections of these docks may be provided with large inflatable pontoons whereby to lift the watercraft completely out of the water. See for example U.S. Pat. No. 6,526,902 referred to hereinabove. Accordingly, it is necessary to pump air into the pontoons and to remove it therefore, whereby the outermost section is only buoyant enough to support itself, whereby it can be downwardly inclined when a watercraft enters the dry dock. This is a time consuming process for docking watercrafts, particularly when a watercraft is docked several times in a single day. Furthermore, the bow ridge of the watercraft impacts onto smaller floatation casings disposed along a center line of the dock, and is subjected to damage, as mentioned above.

SUMMARY OF INVENTION

There is therefore a need to provide a drive-on dry dock, which substantially overcomes the above-mentioned disadvantages of the prior art.

According to a feature of the present invention, there is provided a watercraft support platform casing for a floating dry dock and to which is rigidly secured floatation casings, and wherein a light-weight watercraft can enter the dry dock and propel itself on the support platform casing completely out of the water surface.

Another feature of the present invention is to provide a watercraft support platform casing for use with a floating dry dock, and wherein the floatation casings associated therewith are not impacted by the bow of a watercraft when entering the floating dry dock.

Another feature of the present invention is to provide a watercraft support platform casing for use in the construction of a floating dry dock, and to which is rigidly connected a plurality of floatation casings, and wherein the support platform casing has a lower forward projecting edge and a trough-shaped upper surface with a sloped entry way, whereby to guide a watercraft in movement onto the ramp of the support platform casing.

Another feature of the present invention is to provide a watercraft support platform casing, which can be interconnected in series with a further support platform casing, whereby to form a floating dry dock in combination with floatation casings to support a longer watercraft or two or more light-weight watercrafts in end-to-end relationship and above the water surface.

Another feature of the present invention is to provide a watercraft support platform casing rigidly connectable to floatation casings, whereby to form a drive-on floating dry dock for light-weight watercrafts such as in-board water jet propelled water crafts, making it easy for such water crafts to enter and exit the dry dock.

According to the above features, for a broad aspect, the present invention provides a watercraft support platform casing for a floating dry dock for light-weight watercrafts. The support platform is an elongated rectangular shaped casing dimensioned to support a watercraft elevated from the surrounding water surface. The support platform casing has integrally formed floatation chambers and opposed substantially parallel sidewalls. An elongated central ramp is formed in the top surface of the casing to support a hull of a watercraft position thereon. The ramp has a trough-shaped upper surface with a sloped forward entry way formed integral therewith and terminates in a lower forward projecting edge. The support platform has connectors secured to the opposed sidewalls for rigid interconnection with a plurality of floatation casings by fastening means to form a floating dry dock on a water surface with the entry way of the rainy positioned to receive the hull of a watercraft in movement whereby a watercraft can project itself on the central ramp above the water surface.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
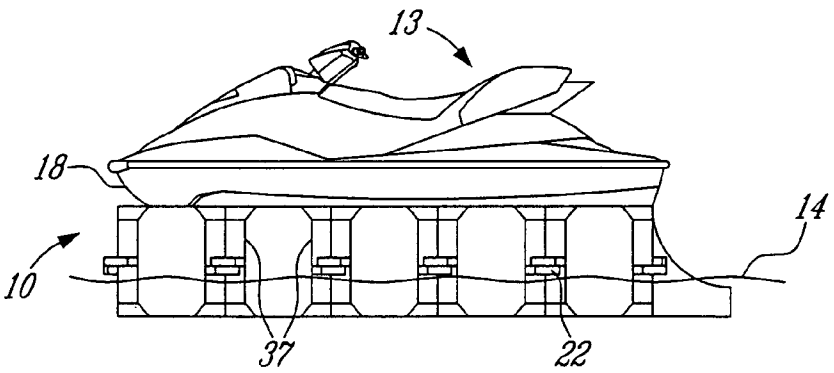
FIG. 1 is a side view of a floating dry dock formed with the support platform casing of the present invention, and shown supporting a light-weight watercraft thereon.
Figure 2:
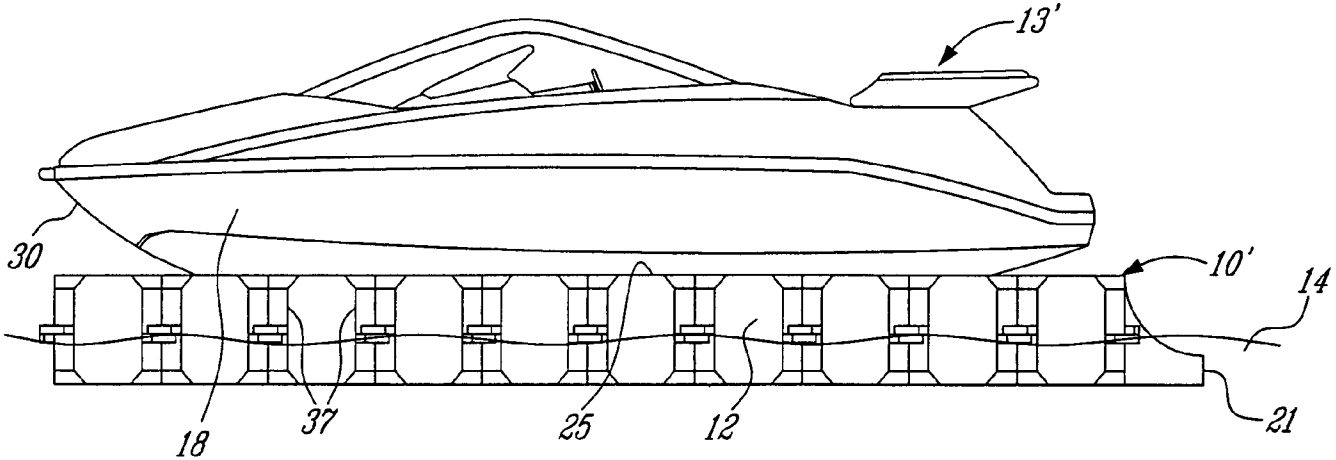
FIG. 2 is a side view similar to FIG. 1, showing a floating dry dock constructed in accordance with the present invention but shown supporting a larger watercraft thereon.

Referring to the drawings, more particularly to FIGS. 1 to 4, there is shown generally at 10 a floating dry dock constructed with the watercraft support platform casing 11 of the present invention, and rigidly interconnected with floatation casings 12. As shown in FIG. 1, the floating dry dock 10, constructed in accordance with the present invention, supports a light-weight watercraft 13 such as an inboard water jet propelled watercraft, above the water surface 14. FIG. 2 shows a larger floating dry dock 10' constructed in accordance with the present invention, and supporting a larger watercraft 13' above the water surface 14.

Figure 3A:
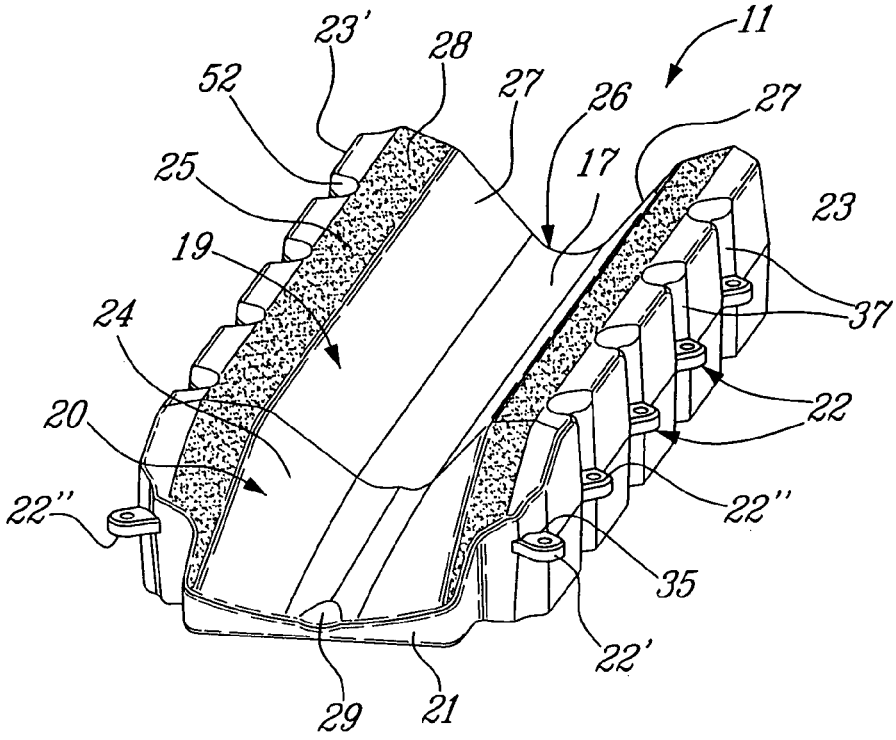
FIG. 3A is a perspective view of the support platform casing constructed in accordance with the present invention.
Figure 3B:
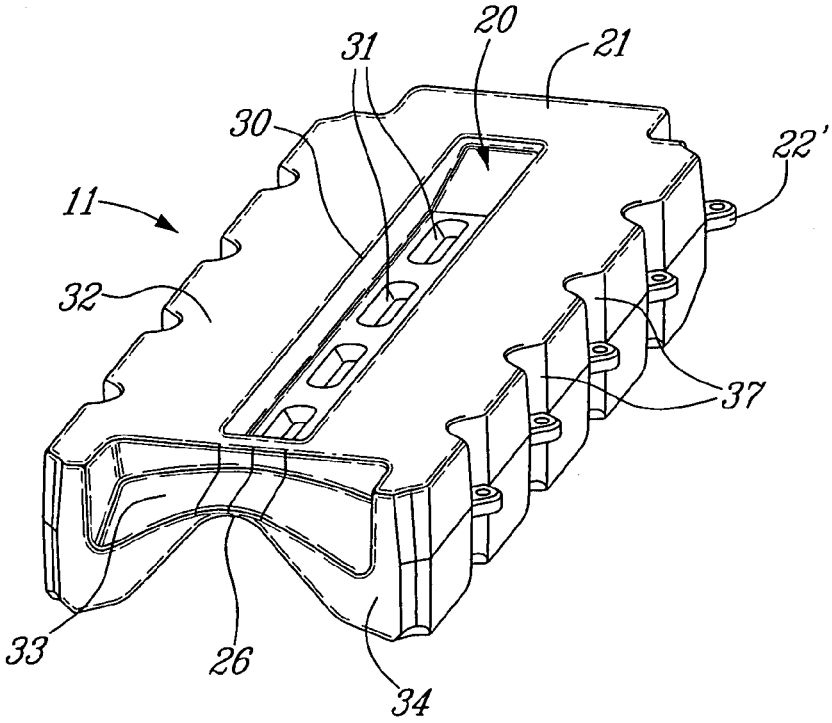
FIG. 3B is a bottom perspective view of the watercraft support platform casing of FIG. 3A.
Figure 4:
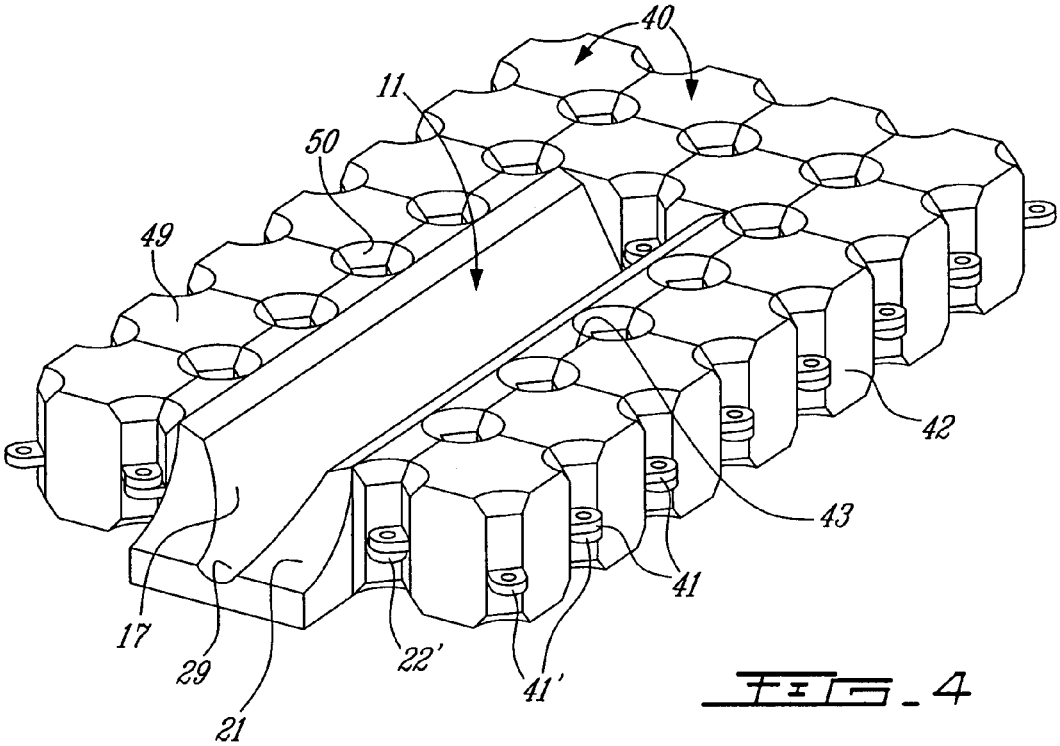
FIG. 4 is a perspective view showing a floating dock constructed in accordance with the present invention, and comprised of a plurality of floatation casings rigidly interconnected together and to the opposed sidewalls of the support platform casing.
Figure 5:
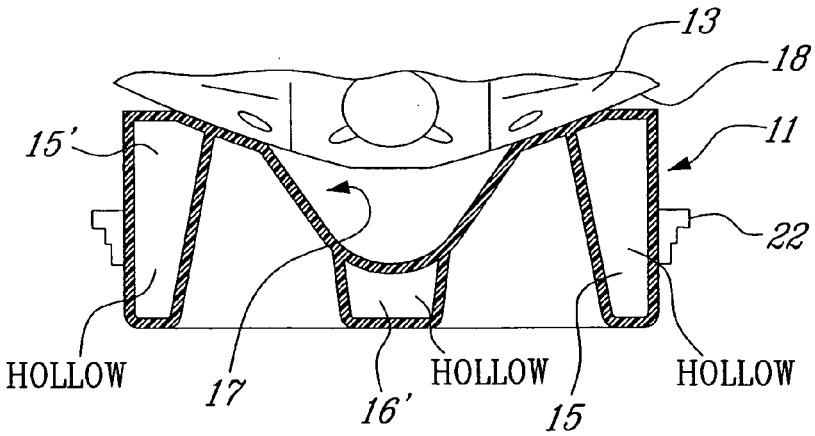
FIG. 5 is a section view through the support platform casing of the present invention showing the integrally formed hollow floatation chambers and the position of the hull of a watercraft supported on the ramp of the support platform casing.

Referring more specifically to FIGS. 3A to 5, there is shown the construction of the support platform casing 11. As herein shown, the support platform casing 11 is molded from rigid plastic material, although it could be constructed of any other suitable material, and is in the shape of an elongated rectangular casing suitably dimensioned to support a watercraft 13 or 13' elevated from a surrounding water surface 14. It is pointed out that several sizes of these casings can be provided and adapted to support different types of watercrafts. The support platform casing 11, as shown in FIG. 5, is of hollow construction and has integrally formed floatation chambers 15 and 15', formed on opposed sides thereof. An additional chamber 16 may be provided in certain areas of a ramp 17. It is conceivable that the floatation chambers be injected with rigid foam material for strength and for preventing water infiltration.

As better illustrated in FIG. 4, the elongated central ramp 17 is formed in a top surface of the support platform casing 11, and is provided to support the hull 18 of the watercrafts 13 and 13'. The ramp 17 has a trough-like upper surface 19 with a sloped entry way 20 formed integral therewith in a forward section thereof. The sloped forward entry way 20 terminates in a lower forward projecting edge 21. As shown in FIGS. 1 and 2, this lower forward projecting edge 21 lies and extends forwardly of an upper forward edge of the casing edge extending forwardly of an upper forward edge of the casing.

The sloped forward entry way 20 is comprised of a rearwardly and upwardly sloping forward section 24 of the ramp 17, whereby to lift out of the water and on to the support platform the watercrafts 13 and 13', entering the support platform at sufficient speed. This sloping forward section is a smooth section and merges into the upper horizontal support section 25, whereby to support the watercraft on the platform casing 11 over the water surface 14, as illustrated in FIGS. 1 and 2. The trough-like upper surface of the ramp defines a central deep V-shaped depression 26 having outwardly sloping side walls 27 on opposed sides thereof, each terminating in an upper gently sloped hull support upper wall section 28, which constitutes the upper horizontal support section 25 of the support platform casing 11. FIG. 5 better illustrates the cross sectional shape of the trough-like upper surface on which is resting opposed hull sections of a watercraft 13 positioned thereon.

As shown, in FIG. 3A, the lower forward projecting edge 21 is provided with a central forward guide cavity 29 to guide the bow center ridge 30 (see FIG. 2) of a watercraft entering into the support platform casing. This guide cavity is formed in a reinforced bottom wall section of the support platform casing 11, as shown in FIG. 3B. The bottom central section 30 of the V-shape depression 26 is formed with reinforcing cavities 31 to solidify the ramp in the forward sloped entry way 20 thereof, where is it subjected to impact by docking watercrafts.

As also shown in FIG. 3B, the bottom wall 32 of the support platform casing 11 has a reinforced coupling cavity 33 in a rear end wall 34 thereof, whereby to receive therein the lower forward projecting edge 21 of another support platform casing 11, when nested end to end, as will be described later.

Figure 6:
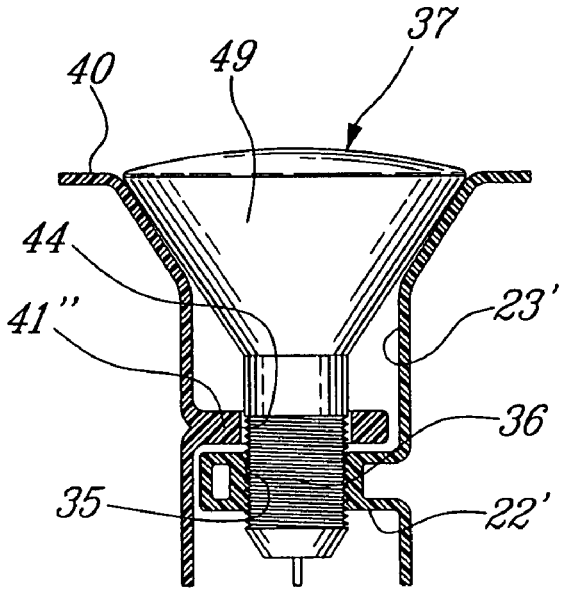
FIG. 6 is a partly fragmented side view of a connector which interconnects a floatation casing to the support platform casing and to adjacent floatation casings.
Figure 7A:
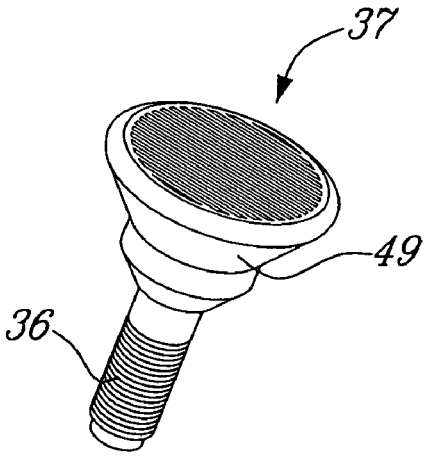
FIG. 7A is a perspective view of the fastener.
Figure 7B:
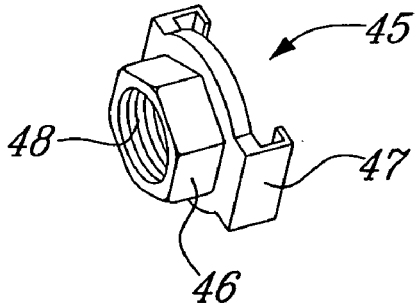
FIG. 7B shows a modification of the fastener wherein a threaded nut is removably securable to the lower connecting flange of the support platform casing.

Referring again to FIGS. 3A and 3B, the watercraft support platform casing 11 is further provided with a plurality of connectors 22 equally spaced in the opposed side walls 23 and 23' of the casing in a common horizontal plane. These connectors 22 are in the form of projecting flanges or tabs 22', each provided with a connecting through bore 35, as better illustrated in FIG. 6, for receiving a threaded shank 36 of a bolt fastener 37 therein. As shown in FIG. 6, this connecting through bore 35 is a threaded through bore. The connectors or tabs 22' are integrally formed with the side walls 23 and 23' of the support platform casing 11 and project from reinforced channel formations 37, which extend vertically in the opposed side walls 23 and 23', as illustrated in FIG. 3A. The projecting tabs provide interconnection of the support platform casing 11 with standard floatation casings 40, as shown in FIG. 4. These floatation casings 40 are well known in the art and are usually of square block form, as herein illustrated, with connecting flanges 41 extending diagonally from opposed corners thereof in a common central horizontal region of the floatation casings. Two of these connector flanges, 41 and 41', on one side of the floatation casings, namely side 42, project lower than the other two connector flanges 41" on the other side 43 of the casings, whereby these connector flanges can overlap to interconnect the floatation casings with another. As shown in FIG. 6, the connecting tabs 22' of the watercraft support platform casing 11 are disposed lowermost whereby to receive an upper most connector flange 41 of a floatation casing 40 there over. As shown in FIG. 6, the connector flange 41" of a floatation casing 40 is disposed over the tab 22' of the floatation casing 11 with the through bore 44 of the connector flange in line with the through bore 35 of the tab 22'. The threaded shank of the bolt fastener 37 extends through these through bores and threaded into the connecting tab 22'. The connecting tabs 22' may also be provided with a smooth through bore and a threaded connector insert 45, as shown in FIG. 7B, may be slidingly secured over the opposed flat parallel surfaces 22" of the tab. As shown in FIG. 7B, the threaded connector insert 45 comprises a threaded nut 46 welded or integrally formed with a slide attachment 47 for slidingly securing the threaded nut under the flange tab 22' with a threaded bore 48 of the nut aligned with the connecting through bore 35, which now has a smooth inner surface so that the threaded shank of the fastener 37 threads into this nut 46 to provide the attachment.

The bolt fastener 37 is provided with a flared head 49 merging into a substantially smooth upper surface, which aligns with the top surface 49 of the floatation casings 40. These large connecting heads 49 mate with smooth angular depressions 50 formed in the top corners of the floatation casings 40. When these casings are secured side by side, they form a conical depression in their corner regions to rigidly interconnect the floatation casings together through the bolt heads to prevent flexion of the connected casings with one another. Likewise, the reinforced channel formations 37 in the side walls 23 and 23' of the support platform casing 11 are provided with top semi-conical depressions 52 to also receive the conical heads 49 of the connectors 37 to provide rigid interconnection of floatation casings with the support platform casing to prevent flexion. Accordingly, when the support platform casing 11 is assembled with floatation casings to form a rigid floating dry dock, the floatation casings and the support platform casing do not flex with respect to one another. This provides for a rigid dry dock to support people and a watercraft thereon.

Figure 9A:
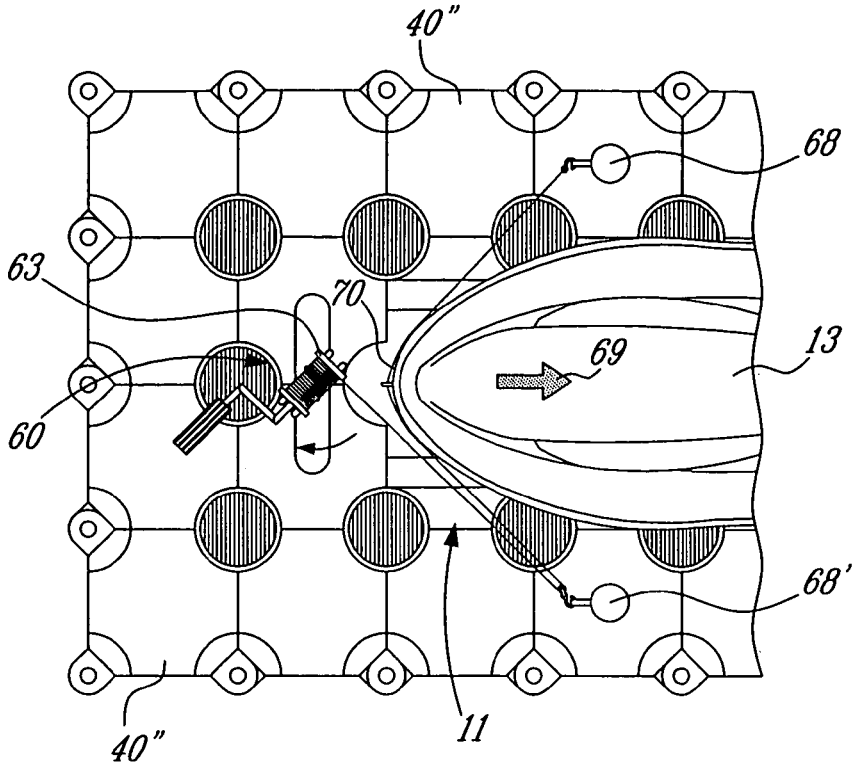
FIG. 9A is a top view similar to FIG. 8B, but showing the winch mechanism arrangement for discharging the watercraft from the support platform casing of the dry dock.
Figure 9B:
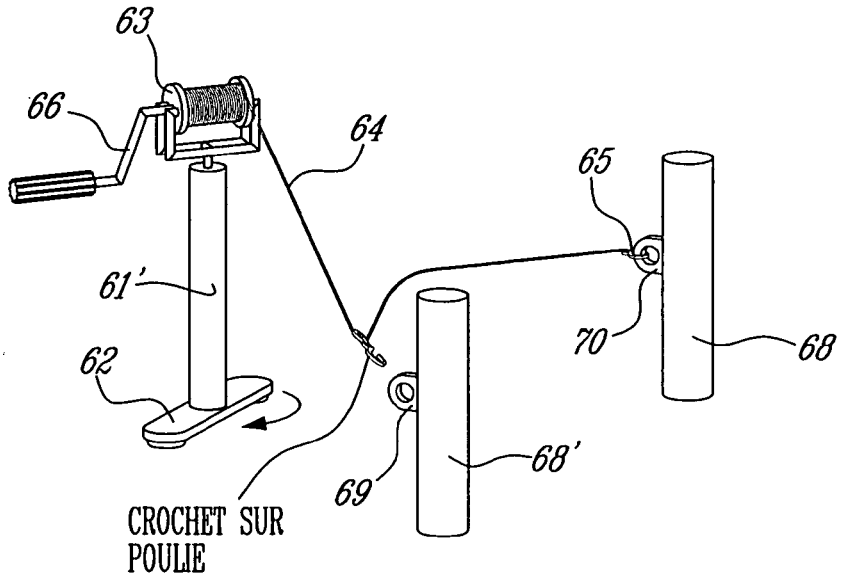
FIG. 9B is a perspective view illustrating the winch mechanism associated attachment post for discharging the watercraft from the dry dock.
Figure 10A:
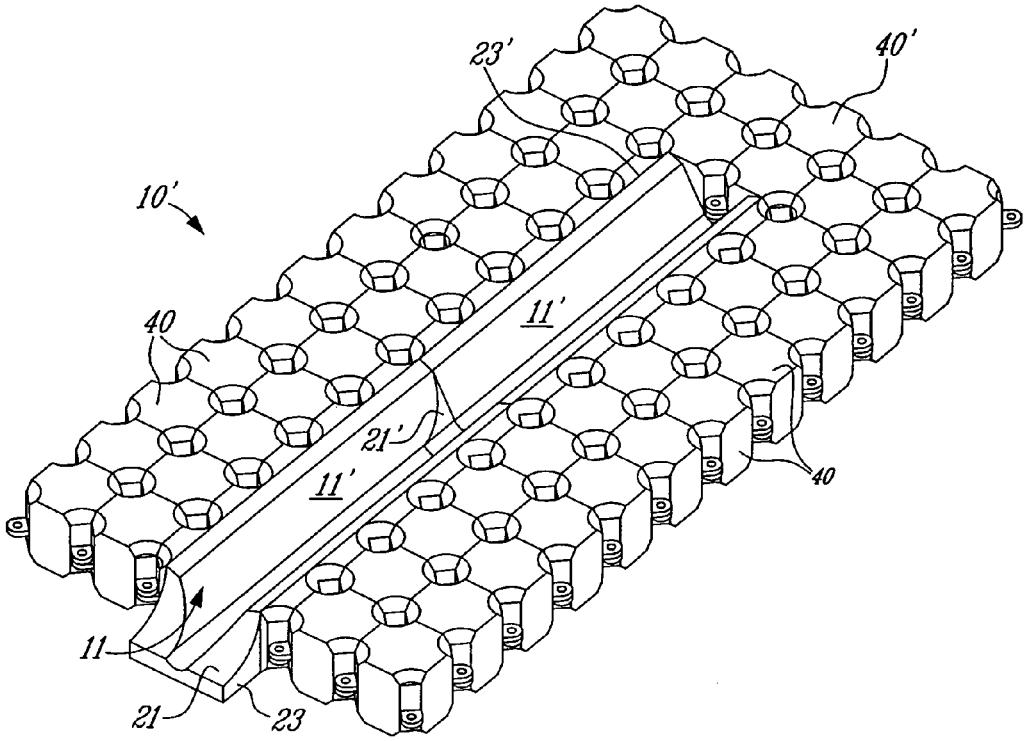
FIG. 10A is a perspective view showing a dry dock constructed with two support platform casings interconnected end to end.
Figure 10B:
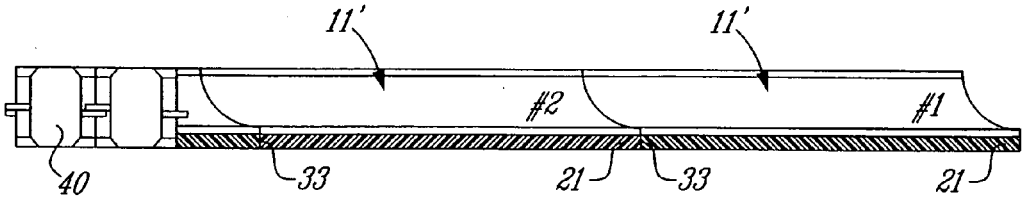
FIG. 10B is a section view showing the two nested support platform casings when connected end to end.

Referring now to FIGS. 10A and 10B, there is shown a larger floatation drive-on dry dock 10' constructed in accordance with the present invention, and wherein there are two watercraft support platform casings 11 secured end to end by the attachments of the surrounding floatation casings 40. As previously described, the support platform casings 11 are disposed end to end with the lower forward projecting edge 21 of casing 11' received in the coupling cavity 33 of the forward support platform casing 11. These casings are held in place by the interconnection of the surrounding floatation casings secured to the connectors 22 in the sidewalls 23 and 23' of each of the floatation casings and connected together. Accordingly, a longer watercraft can be supported on this flotation dry dock 10'. When the watercraft enters the dry dock, it is then pushed or pulled ahead onto the forward support platform casing 11'. To facilitate the positioning of the watercrafts on the floatation casing 11, there may be provided a winch mechanism as will now be described with reference to FIGS. 8A to 9B.

Figure 8A:
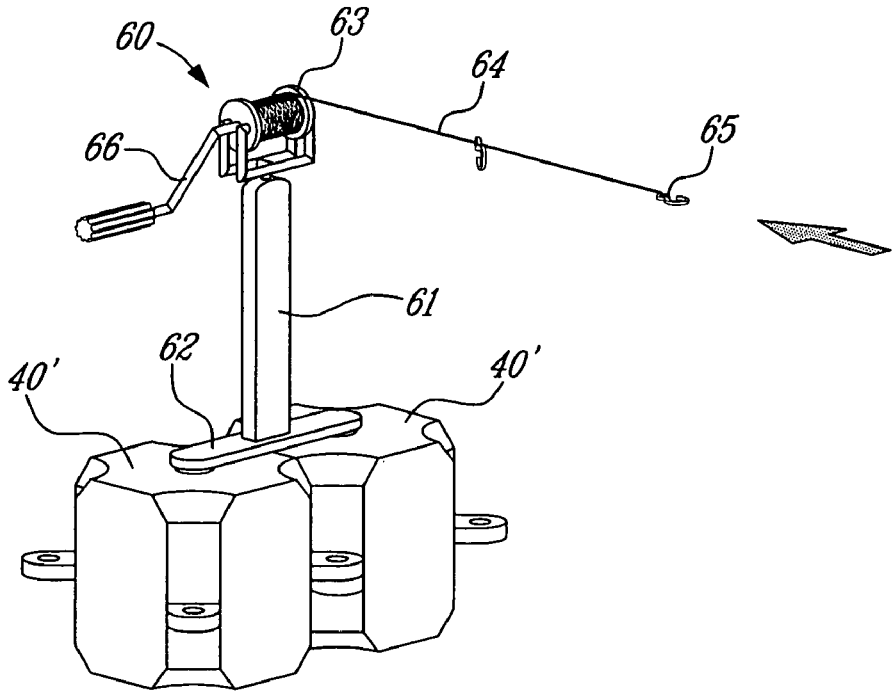
FIG. 8A is a perspective view of a winch mechanism secured to some of the forward floatation casings of a drive-on dry dock constructed in accordance with the present invention.
Figure 8B:
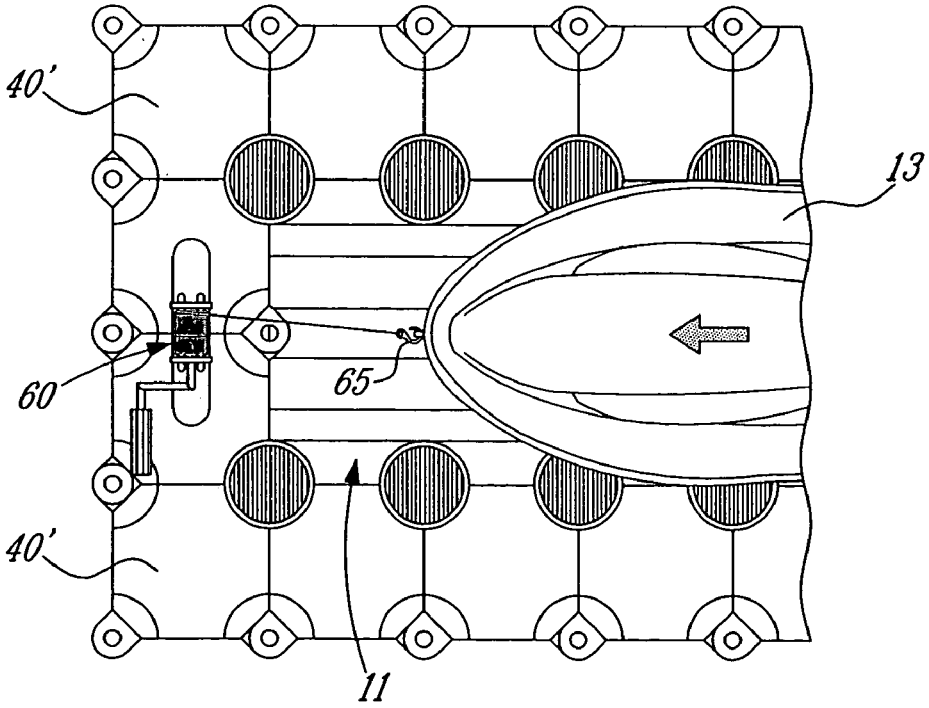
FIG. 8B is a top view showing the winch mechanism having its winch line connected to the forward end of a watercraft being pulled forward onto the support platform casing of the dry dock.

As shown in FIG. 8A, the winch mechanism 60 comprises a connecting pedestal 61 having a securement base 62, which is secured to a pair of forwardly disposed floatation casings 40' positioned forwardly of the support platform casing 11', as shown in FIG. 10A. The winch mechanism has a line spool 63 provided with a winch line 64, which has a hook 65 at a free end thereof for securement of the front of the watercraft, as shown in FIG. 8B. A crank arm 66 operates the spool 63 to winch the watercraft 13 in proper position on the dry dock. Of course, this winch mechanism 60 may be provided on a smaller dry dock, as illustrated in FIG. 4.

A pair of attachment posts 68 and 68' may also be secured to floatation casings 40" on opposed sides of the support platform casing 11, whereby to discharge the watercraft 16 from the floating dry dock by exerting a pushing force in the direction of arrow 69. This is done by passing the winch line 64 through an eyelet 69 secured to post 68', and then securing the hook 65 to a further eyelet 70 associated with the post 68. The winch line 64 is disposed over the bow end 70 of the watercraft 13 and by winding the winch line onto the spool 63, a discharge pressure from the line displaces the watercraft in the direction of arrow 69. As shown in FIG. 9A, the winch spool 63 may be pivotally secured to the top end of the connecting pedestal 61, whereby the spool can swivel to either side of the bow of the watercraft 63. On the other hand, the connecting pedestal 61' may be pivotally secured to the connecting frame 62, as illustrated in FIG. 9B.

It is within the ambit of the present invention to provide any obvious modifications of the preferred embodiment described herein, provided such modifications fall within the scope of the claims.

The invention claimed is:

1. A watercraft support platform casing for a floating dry dock for light weight watercrafts, said support platform being an elongated rectangular shaped casing dimensioned to support a watercraft elevated from a surrounding water surface, said support platform casing having integrally formed floatation chambers and opposed substantially parallel side walls, an elongated central ramp formed in a top surface of said casing to support a hull of a watercraft positioned thereon, said ramp having a trough-shaped upper surface with a sloped forward entryway formed integral therewith and terminating in a lower forward projecting edge, said lower forward projecting edge extending forwardly of an upper forward edge of the casing said support platform casing having connectors secured to said opposed side walls for rigid interconnection with a plurality of floatation casings by fastening means to form a floating dry dock on a water surface with said entryway of said ramp positioned to receive the hull of a watercraft in movement whereby said watercraft can project itself on said central ramp above said water surface, each said connectors being a projecting tab having a threaded connecting through bore accommodating said fastening means to rigidly secure a connecting tab of a floatation casing thereto, said fastening means having a threaded shaft and a flared head having a substantially smooth upper surface, which merges with a top surface of adjacent floatation casings forming said dry dock.

2. A watercraft support platform casing as claimed in claim 1, wherein said casing is a molded casing, said floatation chambers being hallow chambers formed integral with said molded casing and extending at least on opposed sides of said ramp.

3. A watercraft support platform casing as claimed in claim 1, wherein said sloped forward entryway is comprised of a rearwardly and upwardly sloping forward section of said ramp.

4. A watercraft support platform casing as claimed in claim 1, wherein said trough-shaped upper surface of said ramp defines a central deep V-shaped depression having outwardly sloping side walls, each terminating in an upper gently sloped hull support upper wall section for supportingly engaging opposed hull sections of a watercraft positioned thereon.

5. A watercraft support platform casing as claimed in claim 4, wherein said V-shaped depression has a central reinforced bottom wall section.

6. A watercraft support platform casing as claimed in claim 1, wherein said lower forward projecting edge is provided with a central forward guide cavity to guide a bow center ridge of a watercraft entering said ramp.

7. A watercraft support platform casing as claimed in claim 1, wherein said connectors each project from a reinforced channel formation extending vertically in said opposed side walls.

8. A watercraft support platform casing as claimed in claim 1, in combination with a plurality of said floatation casings, said floatation casings being hollow casings of rectangular shape having opposed parallel vertical side walls, a top wall and a bottom wall; and a casing flange connector extending from said side walls of said casings at intersecting corners thereof and disposed in a common horizontal central plane, said flange connectors having a through bore for receiving a fastener for connection with said connectors of said support platform casings, and with flange connectors of other of said floatation casing whereby to form rigid non-flexible dock sections on opposed sides of said support platform casing and forwardly thereof.

9. A watercraft support platform casing as claimed in claim 8, wherein there is further provided a winch mechanism secured to some of said floatation casings and disposed forwardly of said support platform casing.

10. A watercraft support platform casing as claimed in claim 9, wherein there is further provided an attachment post secured to a floatation casing on opposed sides of said support platform casing, said attachment post providing attachment of a winch line to discharge a water craft from said support platform casing by the use of said winch.

11. A watercraft support platform casing as claimed in claim 1, wherein said support platform casing is provided with a coupling cavity in a lower section of a front wall thereof, there being two of said support platform casings interconnected in end-to-end relationship by said floatation casings interconnected together and to said connectors of said two support platforms, said lower forward projecting edge of one of said support platform being received in said coupling cavity of the other of said support platform to form an elongated rigid support platform casing capable of supporting a long watercraft completely out of the water.

12. A watercraft support platform casing as claimed in claim 1, wherein said fastening means are bolt fasteners, each provided with a flared head for locking frictional engagement with conical depressions formed in upper corner sections of said floatation casings and upper end sections of vertical reinforced channel formations in said opposed side walls of said support platform casing to prevent flexion between said floatation casing and said support platform casing.

13. A watercraft support platform casing for a floating dry dock for light weight watercrafts, said support platform being an elongated rectangular shaped casing dimensioned to support a watercraft elevated from a surrounding water surface, said support platform casing having integrally formed floatation chambers and opposed substantially parallel side walls, an elongated central ramp formed in a top surface of said casing to support a hull of a watercraft positioned thereon, said ramp having a trough-shaped upper surface with a sloped forward entryway formed integral therewith and terminating in a lower forward projecting edge, said lower forward projecting edge extending forwardly of an upper forward edge of the casing said support platform casing having connectors secured to said opposed side walls for rigid interconnection with a plurality of floatation casings by fastening means to form a floating dry dock on a water surface with said entryway of said ramp positioned to receive the hull of a watercraft in movement whereby said watercraft can project itself on said central ramp above said water surface, each said connector being a flange tab having a connecting through bore and opposed flat parallel surfaces, each said connector accommodating a respective one of said fastening means, said fastening means having a threaded connector insert having a threaded nut with a slide attachment for slidingly securing said threaded nut under said flange tab with a threaded bore of said nut aligned with said connecting through bore, said connecting through bore having a smooth inner face.

14. A watercraft support platform casing as claimed in claim 13, wherein said casing is a molded casing, said floatation chambers being hollow chambers formed integral with said molded casing and extending at least on opposed sides of said ramp.

15. A watercraft support platform casing as claimed in claim 13, wherein said sloped forward entryway is comprised of a rearwardly and upwardly sloping forward section of said ramp.

16. A watercraft support platform casing as claimed in claim 13, wherein said trough-shaped upper surface of said ramp defines a central deep V-shaped depression having outwardly sloping side walls, each terminating in an upper gently sloped hull support upper wall section for supportingly engaging opposed hull sections of a watercraft positioned thereon.

17. A watercraft support platform casing as claimed in claim 16, wherein said V-shaped depression has a central reinforced bottom wall section.

18. A watercraft support platform casing as claimed in claim 13, wherein said lower forward projecting edge is provided with a central forward guide cavity to guide a bow center ridge of a watercraft entering said ramp.

19. A watercraft support platform casing as claimed in claim 13, wherein said connectors each project from a reinforced channel formation extending vertically in said opposed side walls.

20. A watercraft support platform casing as claimed in claim 13, in combination with a plurality of said floatation casings, said floatation casings being hollow casings of rectangular shape having opposed parallel vertical side walls, a top wall and a bottom wall; and a casing flange connector extending from said side walls of said casings at intersecting corners thereof and disposed in a common horizontal central plane, said flange connectors having a through bore for receiving a fastener for connection with said connectors of said support platform casings, and with flange connectors of other of said floatation casing whereby to form rigid non-flexible dock sections on opposed sides of said support platform casing and forwardly thereof.

21. A watercraft support platform casing as claimed in claim 20, wherein there is further provided a winch mechanism secured to some of said floatation casings and disposed forwardly of said support platform casing.

22. A watercraft support platform casing as claimed in claim 21, wherein there is further provided an attachment post secured to a floatation casing on opposed sides of said support platform casing, said attachment post providing attachment of a winch line to discharge a water craft from said support platform casing by the use of said winch.

23. A watercraft support platform casing as claimed in claim 13, wherein said support platform casing is provided with a coupling cavity in a lower section of a front wall thereof there being two of said support platform casings interconnected in end-to-end relationship by said floatation casings interconnected together and to said connectors of said two support platforms, said lower forward projecting edge of one of said support platform being received in said coupling cavity of the other of said support platform to form an elongated rigid support platform casing capable of supporting a long watercraft completely out of the water.

24. A watercraft support platform casing as claimed in claim 13, wherein said fastening means are bolt fasteners, each provided with a flared head for locking frictional engagement with conical depressions formed in upper corner sections of said floatation casings and upper end sections of vertical reinforced channel formations in said opposed side walls of said support platform casing to prevent flexion between said floatation casing and said support platform casing.

* * * * *